US011776740B2

(12) United States Patent
Suzuki et al.

(10) Patent No.: US 11,776,740 B2
(45) Date of Patent: Oct. 3, 2023

(54) SPARK COIL WITH THE LEAD TERMINAL BETWEEN FLANGES

(71) Applicant: Mitsubishi Electric Corporation, Tokyo (JP)

(72) Inventors: Daisuke Suzuki, Tokyo (JP); Shuji Yamada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/587,737

(22) Filed: Jan. 28, 2022

(65) Prior Publication Data

US 2023/0123021 A1 Apr. 20, 2023

(30) Foreign Application Priority Data

Oct. 18, 2021 (JP) ..... 2021-170079

(51) Int. Cl.
*H01F 38/12* (2006.01)
*H01F 5/02* (2006.01)

(52) U.S. Cl.
CPC ..... *H01F 38/12* (2013.01); *H01F 5/02* (2013.01); *H01F 2005/022* (2013.01)

(58) Field of Classification Search
CPC ..... H01F 38/12; H01F 5/02; H01F 2005/022
See application file for complete search history.

(56) References Cited

U.S. PATENT DOCUMENTS 4,918,419 A * 4/1990 Ida ..... H01F 5/04 336/107
4,962,361 A * 10/1990 Ida ..... H01F 5/04 336/107
5,357,233 A * 10/1994 Wada ..... H01F 38/12 336/107
5,959,407 A * 9/1999 Ito ..... F21S 41/172 315/276
10,749,318 B2 * 8/2020 Akimoto ..... F02P 3/04

FOREIGN PATENT DOCUMENTS

JP 61-107712 A 5/1986
JP 2001-93759 A 4/2001
JP 2008-021794 A 1/2008
JP 2016-171098 A 9/2016

OTHER PUBLICATIONS

Office Action dated Jul. 5, 2022 in Japanese Application No. 2021-170079 English Translation.

* cited by examiner

*Primary Examiner* — Gonzalo Laguarda
(74) *Attorney, Agent, or Firm* — Sughrue Mion, PLLC; Richard C. Turner

(57) ABSTRACT

A spark coil includes: a center core; a primary coil disposed on an outer periphery of the center core; a secondary coil disposed on an outer periphery of the primary coil; and an output terminal electrically connected to the secondary coil. The secondary coil includes a tubular secondary bobbin having a plurality of flanges on an outer peripheral side thereof, a secondary conductive wire wound around the secondary bobbin, and a long-sheet-shaped secondary lead terminal having one and another end portions electrically connected to the secondary conductive wire and the output terminal, respectively. The secondary lead terminal is disposed, between corresponding ones of the flanges, in surface contact with none of side surfaces of the flanges.

10 Claims, 7 Drawing Sheets

SPARK COIL WITH THE LEAD TERMINAL BETWEEN FLANGES

BACKGROUND OF THE INVENTION

1. Field of the Invention

The present disclosure relates to a spark coil.

2. Description of the Background Art

An internal-combustion engine represented by an engine for automobiles includes a spark coil for applying high voltage to a spark plug. The spark coil includes: a center core having the shape of a quadrangular prism; a primary coil disposed on an outer peripheral side of the center core; a secondary coil disposed on an outer peripheral side of the primary coil; and side cores disposed at both ends of the center core. The spark coil is a transformer composed of these components. Each side core is disposed on an outer side of the secondary coil. These components are electrically connected to a connector module and an output terminal. Then, the components are, together with the connector module and the output terminal, secured by means of an insulating resin and fixed inside a case. The connector module has a connector to be connected to a vehicle harness. The output terminal is connected to the spark plug of the internal-combustion engine via a spring.

In general, each of the center core and the side core is made of electromagnetic steel sheets that are stacked on each other. As the insulating resin, a thermosetting resin such as epoxy resin is used. The secondary coil includes a tubular secondary bobbin and a secondary conductive wire wound around the secondary bobbin. The output terminal is electrically connected to the secondary conductive wire. In the spark coil, it is important to assuredly connect the output terminal and the secondary conductive wire to each other when the components are secured by means of the insulating resin and fixed inside the case. A spark coil has been disclosed in order to address this problem. The spark coil includes a lead terminal on an output terminal side and a lead terminal on a secondary conductive wire side. The lead terminals are bent so as to be capable of being fitted to each other. In this spark coil, a bent portion of the lead terminal on the secondary conductive wire side is press-fitted into a secondary bobbin, and, at the time of assembling, a bent portion of the lead terminal on the output terminal side is fitted to the bent portion of the lead terminal on the secondary conductive wire side so that electrical connection between the output terminal and the secondary conductive wire is ensured (see, for example, Patent Document 1).

Patent Document 1: Japanese Laid-Open Patent Publication No. 2008-21794

However, since the conventional spark coil requires the two lead terminals, i.e., the lead terminal on the output terminal side and the lead terminal on the secondary conductive wire side, a drawback arises in that the number of components is large so that cost is high. Further, since the temperature of the internal-combustion engine greatly changes, the lead terminals of the spark coil repetitively undergo thermal expansion and thermal shrinkage owing to repetitive changes in the temperature of the internal-combustion engine. Since the bent portion of the lead terminal on the secondary conductive wire side is press-fitted into the secondary bobbin in the conventional spark coil, the repetitive thermal expansion and thermal shrinkage of the said lead terminal cause drawbacks in that: the lead terminal is separated from the secondary bobbin; and a crack is generated in the secondary bobbin.

SUMMARY OF THE INVENTION

The present disclosure has been made to solve the above drawbacks, and an object of the present disclosure is to provide a spark coil that requires low cost, and that can inhibit separation of a lead terminal from a secondary bobbin and inhibit generation of cracks in the secondary bobbin.

A spark coil according to the present disclosure includes: a center core; a primary coil disposed on an outer periphery of the center core; a secondary coil disposed on an outer periphery of the primary coil; and an output terminal electrically connected to the secondary coil. The secondary coil includes a tubular secondary bobbin having a plurality of flanges on an outer peripheral side thereof, a secondary conductive wire wound around the secondary bobbin, and a long-sheet-shaped secondary lead terminal having one end portion electrically connected to the secondary conductive wire and having another end portion electrically connected to the output terminal. The secondary lead terminal is disposed between corresponding ones of the flanges so as to be in surface contact with none of side surfaces of the flanges.

In the spark coil according to the present disclosure, the secondary coil includes the tubular secondary bobbin having the plurality of flanges on the outer peripheral side thereof, the secondary conductive wire wound around the secondary bobbin, and the long-sheet-shaped secondary lead terminal having the one end portion electrically connected to the secondary conductive wire and having the other end portion electrically connected to the output terminal. The secondary lead terminal is disposed between the corresponding flanges so as to be in surface contact with none of the side surfaces of the flanges. Consequently, the spark coil requires low cost, and can inhibit separation of the secondary lead terminal from the secondary bobbin and inhibit generation of cracks in the secondary bobbin.

DETAILED DESCRIPTION OF THE PREFERRED EMBODIMENTS OF THE INVENTION

Figure 1:
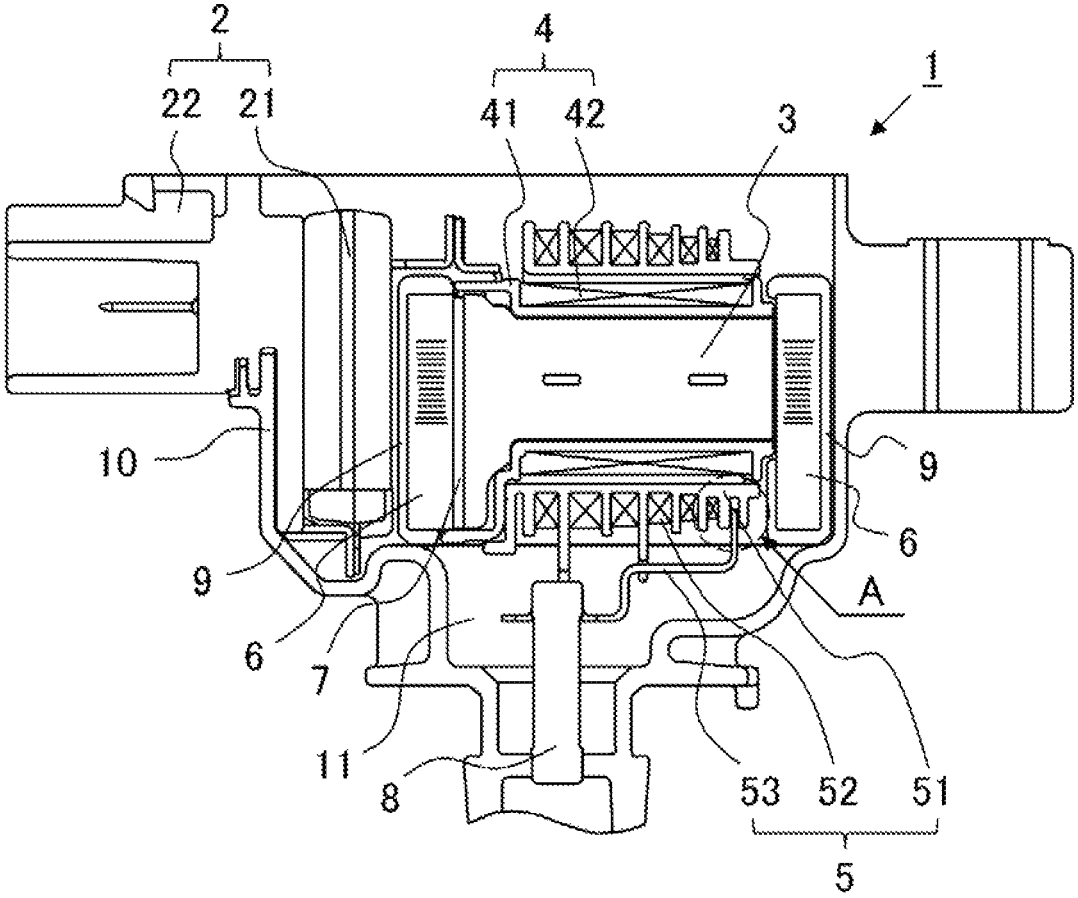
FIG. 1 is a cross-sectional view of a spark coil according to a first embodiment.

Hereinafter, spark coils according to embodiments for carrying out the present disclosure will be described in detail with reference to the drawings. In the drawings, the same or corresponding portions are denoted by the same reference characters.

First Embodiment

FIG. 1 is a cross-sectional view of a spark coil according to a first embodiment. A spark coil 1 according to the present embodiment includes: a connector module 2; a center core 3 having the shape of a quadrangular prism; a primary coil 4 disposed on an outer periphery of the center core 3; a secondary coil 5 disposed on an outer periphery of the primary coil 4; side cores 6 disposed at both ends of the center core 3; a magnet 7 disposed at one of the ends of the center core 3; and an output terminal 8. Core covers 9 are disposed on outer sides of the side cores 6. The connector module 2 includes an ignitor 21 and a connector terminal 22. The primary coil 4 is composed of a tubular primary bobbin 41 and a primary conductive wire 42 wound around the center core 3 with the primary bobbin 41 interposed therebetween. The secondary coil 5 is composed of a tubular secondary bobbin 51, a secondary conductive wire 52 wound around the primary coil 4 with the secondary bobbin 51 interposed therebetween, and a secondary lead terminal 53 electrically connecting the secondary conductive wire 52 and the output terminal 8 to each other. The secondary bobbin 51 has a plurality of flanges on an outer peripheral side thereof. The secondary conductive wire 52 is wound, between corresponding ones of the flanges, around the secondary bobbin 51. These components are fixed inside a case 10 by means of an insulating resin 11, except that the connector terminal 22 of the connector module and one end portion of the output terminal 8 are exposed to the outside of the case 10.

Each of the center core 3 and the side cores 6 is made of, for example, electromagnetic steel sheets that are stacked on each other. Each of the primary conductive wire 42 and the secondary conductive wire 52 is made of, for example, a copper wire. Each of the primary bobbin 41 and the secondary bobbin 51 is made of a resin. The secondary lead terminal 53 is made of, for example, a metal such as brass, iron, copper, nickel, or stainless steel. The magnet 7 is magnetized in a direction opposite to a direction of a magnetic flux generated by electrical conduction to the primary coil 4. Each side core 6 has an O shape or a C shape so as to form a closed magnetic path together with the center core 3 and the magnet 7. Each core cover 9 is formed so as to cover at least a part of the corresponding side core 6. The core cover 9 is obtained by insert molding together with the side core 6, or molded as a component that is separate from the side core 6. The ignitor 21 includes a switching control circuit that causes and interrupts electrical conduction to the primary coil 4. The connector terminal 22 is fastened to an engine harness. The insulating resin 11 is, for example, a thermosetting epoxy resin.

Figure 2:
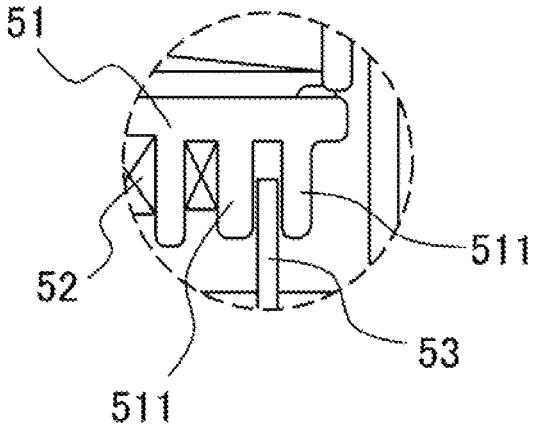
FIG. 2 is an enlarged cross-sectional view of the spark coil according to the first embodiment.

FIG. 2 is an enlarged cross-sectional view of the portion indicated by "A" in FIG. 1. The secondary bobbin 51 has a plurality of flanges 511 protruding to the outer peripheral side thereof. The secondary lead terminal 53 is made of a sheet-shaped material. The intervals between the flanges 511 are set to be larger than the thickness of the sheet-shaped secondary lead terminal 53. The secondary lead terminal 53 is disposed between corresponding ones of the flanges 511 so as to be in surface contact with none of side surfaces of the flanges 511.

Figure 3:
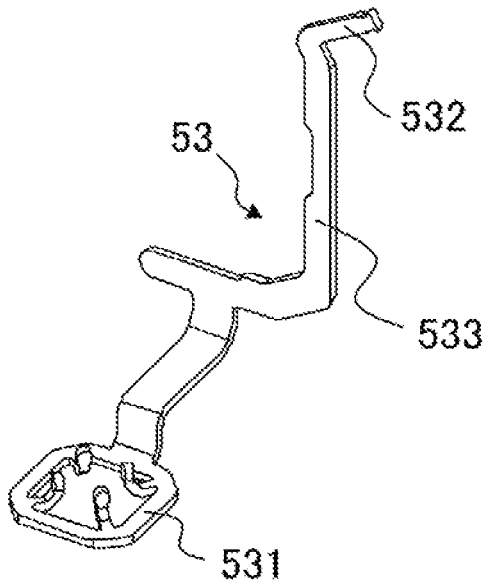
FIG. 3 is a perspective view of a secondary lead terminal in the first embodiment.

FIG. 3 is a perspective view of the secondary lead terminal in the present embodiment. As shown in FIG. 3, the secondary lead terminal 53 is formed as one piece by performing press work on a long-sheet-shaped material. One end portion of the secondary lead terminal 53 is a transmission portion 531 which is electrically connected to the output terminal 8. The transmission portion 531 is configured to allow insertion therethrough of the output terminal 8 and electrical connection to the output terminal 8. Another end portion of the secondary lead terminal 53 is a connection portion 532 which is electrically connected to the secondary conductive wire 52. The connection portion 532 is configured to allow the secondary conductive wire 52 to be wound around the connection portion 532. The transmission portion 531 and the connection portion 532 are coupled to each other at a coupling portion 533.

Figure 4:
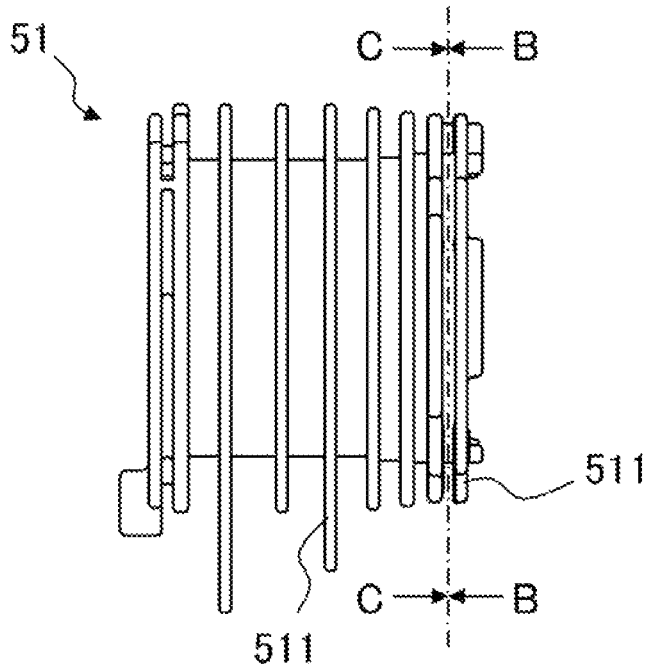
FIG. 4 is a side view of a secondary bobbin in the first embodiment.

FIG. 4 is a side view of the secondary bobbin in the present embodiment. The secondary bobbin 51 is provided with the plurality of flanges 511 on the outer peripheral side thereof. The intervals between the flanges 511 are set to be larger than the thickness of the sheet-shaped secondary lead terminal 53. In FIG. 4, the coupling portion 533 of the secondary lead terminal 53 is disposed between the rightmost one of the flanges 511 of the secondary bobbin 51 and a flange 511 on the left side of the rightmost flange 511. The secondary conductive wire is wound between the other ones of the flanges 511.

Figure 5:
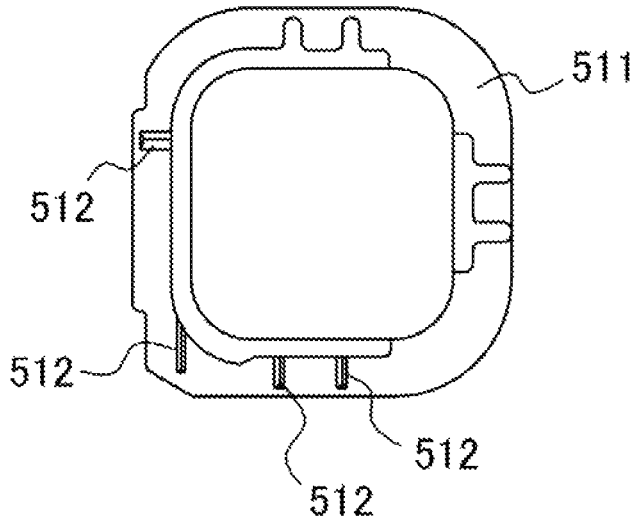
FIG. 5 is a side view of the secondary bobbin in the first embodiment.
Figure 6:
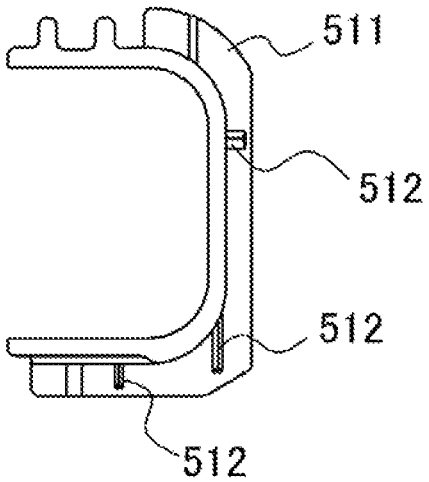
FIG. 6 is a side view of the secondary bobbin in the first embodiment.

FIG. 5 is a side view of the secondary bobbin at the position indicated by the alternate long and short dashed line in FIG. 4, as seen in the direction indicated by the arrow B. FIG. 6 is a side view of the secondary bobbin at the position indicated by the alternate long and short dashed line in FIG. 4, as seen in the direction indicated by the arrow C. The position indicated by the alternate long and short dashed line in FIG. 4 is a position at which the coupling portion 533 of the secondary lead terminal 53 is disposed between the corresponding flanges 511. As shown in FIG. 5 and FIG. 6, ribs 512 each having a triangular cross section are formed on surfaces, of the flanges 511, that face the secondary lead terminal 53. The coupling portion 533 of the secondary lead terminal 53 disposed between the flanges 511 is fixed by being sandwiched between the ribs 512. It is noted that the secondary bobbin made of a resin is ordinarily produced through molding with a mold. Thus, the longitudinal direction of each rib is preferably parallel to a parting direction of the mold.

Figure 7:
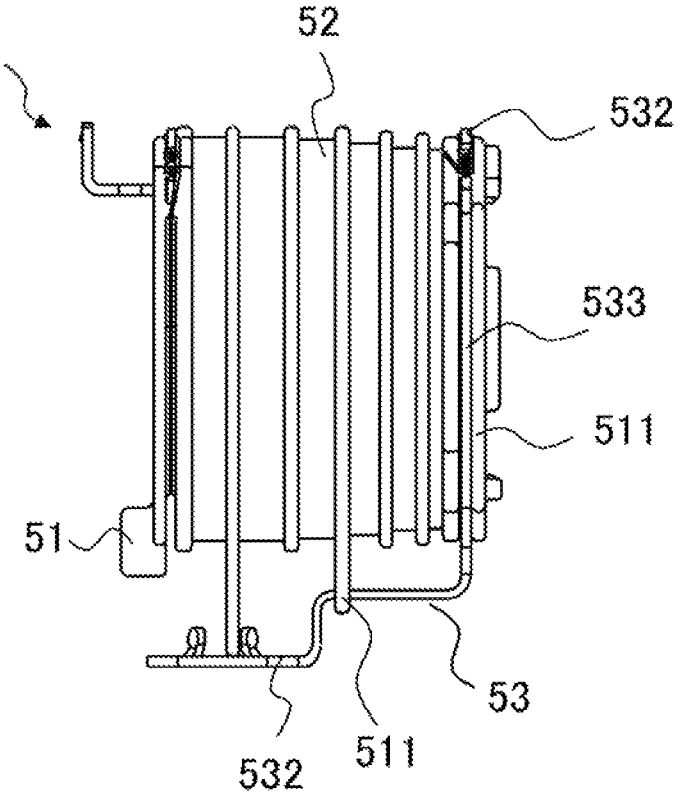
FIG. 7 is a side view of a secondary coil in the first embodiment.
Figure 8:
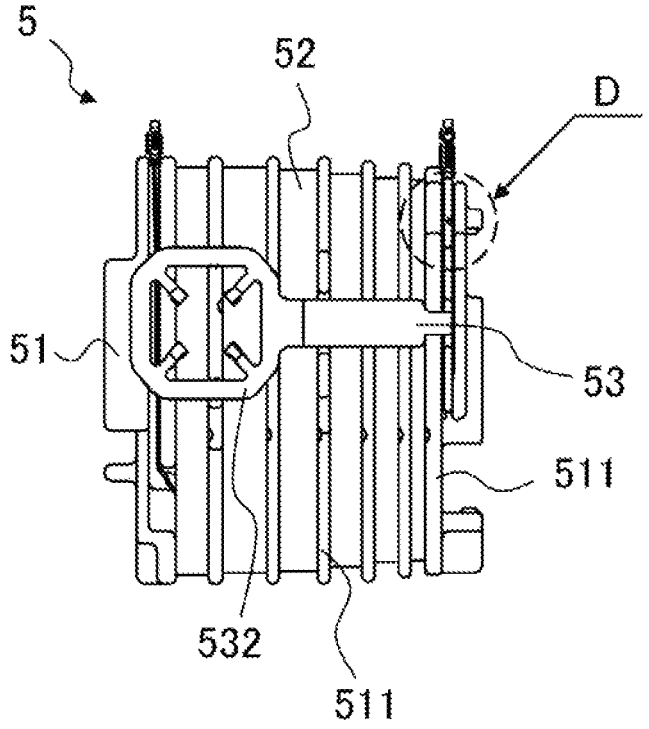
FIG. 8 is a bottom view of the secondary coil in the first embodiment.
Figure 9:
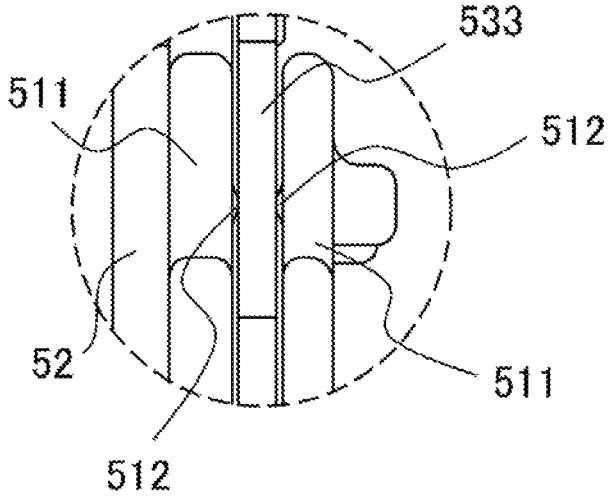
FIG. 9 is an enlarged view of the secondary coil in the first embodiment.

FIG. 7 is a side view of the secondary coil in the present embodiment. FIG. 8 is a bottom view of the secondary coil. As shown in FIG. 7 and FIG. 8, the secondary conductive wire 52 is wound between the corresponding flanges 511 of the secondary bobbin 51 in the secondary coil 5. The secondary lead terminal 53 has the coupling portion 533 disposed between the rightmost one of the flanges 511 of the secondary bobbin 51 and the flange 511 on the left side of the rightmost flange 511. An end portion of the secondary conductive wire 52 is wound around the connection portion 532 of the secondary lead terminal 53. FIG. 9 is an enlarged cross-sectional view of the portion indicated by "D" in FIG. 8. As shown in FIG. 9, the coupling portion 533 of the secondary lead terminal 53 is disposed between the corresponding flanges 511 and sandwiched between the ribs 512. Each rib 512 has a triangular cross section. Thus, the coupling portion 533 of the secondary lead terminal 53 is not in surface contact with the flanges 511 but is in line contact with the flanges 511. Judging from this, the rib 512 can be referred to also as a line-shaped protrusion.

In the spark coil configured as described above, the secondary lead terminal 53 is disposed between the corresponding flanges 511 so as to be in surface contact with none of the side surfaces of the flanges 511. Thus, even if the secondary lead terminal 53 repetitively undergoes thermal expansion and thermal shrinkage owing to repetitive changes in the temperature of the internal-combustion engine, the spark coil according to the present embodiment can inhibit separation of the secondary lead terminal 53 from the secondary bobbin 51 and inhibit generation of cracks in the secondary bobbin 51 since the secondary lead terminal 53 is apart from the secondary bobbin 51.

It is noted that the ribs each having a triangular cross section are formed on the side surfaces of the flanges in the present embodiment. Protrusions that are alternatives to the ribs may be protrusions with any shapes as long as the protrusions are line-shaped protrusions that are in line contact with the secondary lead terminal. Further, the ribs are formed on the side surfaces of the flanges of the secondary bobbin in the present embodiment. Alternatively, the ribs may be formed on surfaces, of the secondary lead terminal, that face the flanges. Moreover, a noise-preventing resistance element may be used as the output terminal in the spark coil according to the present embodiment.

Second Embodiment

In the spark coil according to the first embodiment, the line-shaped protrusions are formed on the side surfaces of the corresponding flanges of the secondary bobbin, and the secondary lead terminal is in line contact with the flanges so that the secondary lead terminal is fixed. Meanwhile, in a spark coil according to a second embodiment, the secondary lead terminal is in point contact with the flanges so that the secondary lead terminal is fixed.

The configuration of the spark coil according to the present embodiment is similar to the configuration of the spark coil according to the first embodiment. The spark coil according to the present embodiment includes a secondary bobbin in which, unlike in the secondary bobbin in the first embodiment, conical protrusions are formed instead of the ribs formed on the side surfaces of the flanges. The coupling portion of the secondary lead terminal is disposed between the flanges so as to be fixed by being sandwiched between the conical protrusions. Thus, the coupling portion of the secondary lead terminal is not in surface contact with the flanges but is in point contact with the flanges. Judging from this, the conical protrusions can be referred to also as needle-shaped protrusions.

In the spark coil configured as described above, the secondary lead terminal is disposed between the corresponding flanges so as to be in surface contact with none of the side surfaces of the flanges. Thus, even if the secondary lead terminal repetitively undergoes thermal expansion and thermal shrinkage owing to repetitive changes in the temperature of the internal-combustion engine, the spark coil according to the present embodiment can inhibit separation of the secondary lead terminal from the secondary bobbin 51 and inhibit generation of cracks in the secondary bobbin 51.

It is noted that the conical protrusions are formed on the side surfaces of the flanges in the present embodiment. Protrusions that are alternatives to the conical protrusions may be protrusions with any shapes as long as the protrusions are needle-shaped protrusions that are in point contact with the secondary lead terminal. Further, in the present embodiment, the needle-shaped protrusions are formed on the side surfaces of the flanges of the secondary bobbin. Alternatively, the needle-shaped protrusions may be formed on the surfaces, of the secondary lead terminal, that face the flanges.

Third Embodiment

Figure 10:
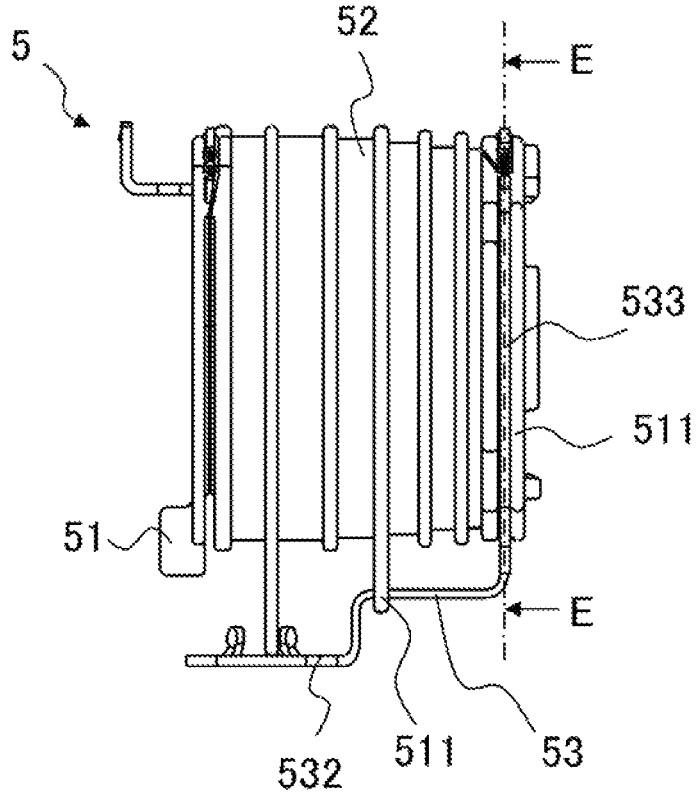
FIG. 10 is a side view of a secondary coil in a third embodiment.
Figure 11:
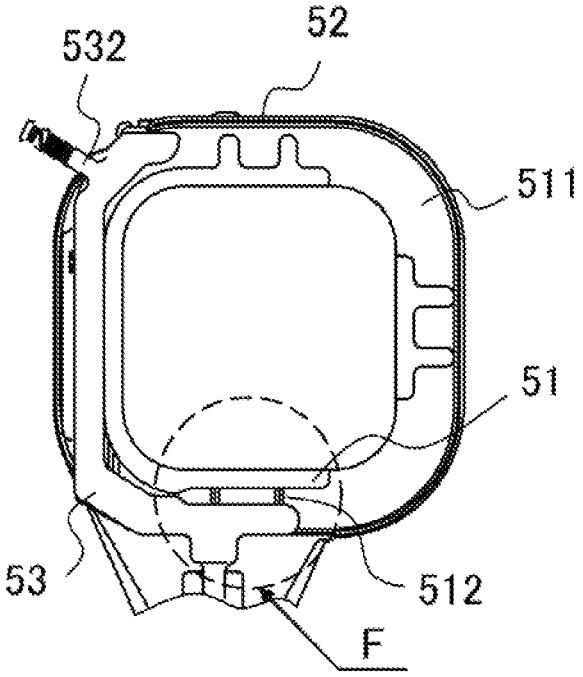
FIG. 11 is a side view of the secondary coil in the third embodiment.
Figure 12:
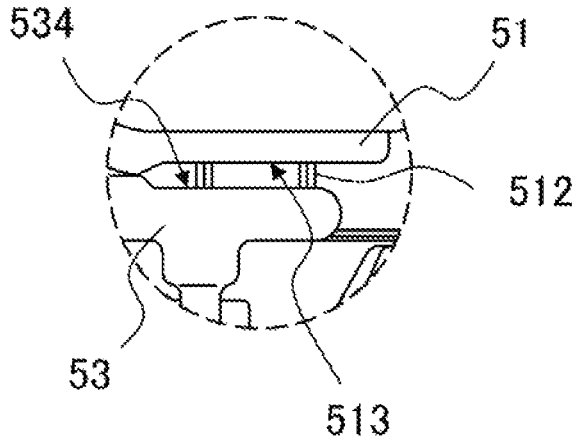
FIG. 12 is an enlarged view of the secondary coil in the third embodiment.

FIG. 10 is a side view of a secondary coil of a spark coil according to a third embodiment. FIG. 11 is a side view of the secondary coil at the position indicated by the alternate long and short dashed line in FIG. 10, as seen in the direction indicated by the arrow E. FIG. 12 is an enlarged cross-sectional view of the portion indicated by "F" in FIG. 11.

The configuration of the spark coil according to the present embodiment is similar to the configuration of the spark coil according to the first embodiment. The spark coil according to the present embodiment is, unlike the spark coil according to the first embodiment, provided with a gap between the secondary lead terminal and a body portion of the secondary bobbin. As shown in FIG. 12, in the spark coil according to the present embodiment, a cut portion 513 is formed on the secondary bobbin 51 side, in a position across which the secondary lead terminal 53 and the body portion of the secondary bobbin 51 face each other. Further, a cut portion 534 is formed also on the secondary lead terminal 53 side, at the same position.

In the spark coil configured as described above, a path to be filled with the insulating resin having fluidity is obtained between the secondary bobbin and the secondary lead terminal when the secondary coil is fixed inside the case together with the insulating resin. Thus, the gap between the secondary bobbin and the secondary lead terminal is assuredly filled with the insulating resin having fluidity at the time of producing the spark coil. As a result, voids or the like do not remain inside the insulating resin that has been cured, whereby voltage endurance characteristics of the spark coil are improved. In particular, the path to be filled with the insulating resin can be assuredly obtained also between the ribs 512 by, as shown in FIG. 12, providing the cut portions in a position around which the ribs 512 are formed.

It is noted that, in order to obtain the path to be filled with the insulating resin, only either of the cut portion 513 on the secondary bobbin 51 side and the cut portion 534 on the secondary lead terminal 53 side has to be formed.

Although the disclosure is described above in terms of exemplary embodiments, it should be understood that the various features, aspects, and functionality described in the embodiments are not limited in their applicability to the particular embodiment with which they are described, but instead can be applied alone or in various combinations to the embodiments of the disclosure.

It is therefore understood that numerous modifications which have not been exemplified can be devised without departing from the scope of the specification of the present disclosure. For example, at least one of the constituent components may be modified, added, or eliminated.

DESCRIPTION OF THE REFERENCE CHARACTERS

1 spark coil
2 connector module

3 center core
4 primary coil
5 secondary coil
6 side core
7 magnet
8 output terminal
9 core cover
10 case
21 ignitor
22 connector terminal
41 primary bobbin
42 primary conductive wire
51 secondary bobbin
52 secondary conductive wire
53 secondary lead terminal
511 flange
512 rib
513 cut portion
531 transmission portion
532 connection portion
533 coupling portion
534 cut portion

What is claimed is:

1. A spark coil comprising:

a center core;

a primary coil disposed on an outer periphery of the center core;

a secondary coil disposed on an outer periphery of the primary coil; and an output terminal electrically connected to the secondary coil, wherein the secondary coil includes a tubular secondary bobbin having a plurality of flanges on an outer peripheral side thereof, a secondary conductive wire wound around the secondary bobbin, and a sheet-shaped secondary lead terminal having one end portion electrically connected to the secondary conductive wire and having another end portion electrically connected to the output terminal, each flange of the plurality of flanges comprises a protrusion protruding from a side surface of the flange, the secondary lead terminal is disposed between corresponding ones of the flanges so as to be in contact with corresponding protrusions of the flanges.

2. The spark coil according to claim 1, wherein the protrusion of each flange of the plurality of flanges comprises a rib, and wherein the secondary lead terminal is disposed so as to be in line contact with the corresponding ribs formed on the side surfaces of the flanges.

3. The spark coil according to claim 1, wherein at least one of the secondary lead terminal and each of the side surfaces of the flanges includes a plurality of line-shaped protrusions.

4. The spark coil according to claim 1, wherein the protrusion of each flange of the plurality of flanges comprises a conical protrusion, and wherein the secondary lead terminal is disposed so as to be in point contact with the corresponding conical protrusions formed on the side surfaces of the flanges.

5. The spark coil according to claim 1, wherein at least one of the secondary lead terminal and each of the side surfaces of the flanges includes a plurality of needle-shaped protrusions.

6. The spark coil according to claim 1, wherein a cut portion is formed in at least one of the secondary bobbin and the secondary lead terminal, in a position across which the secondary bobbin and the secondary lead terminal oppose each other.

7. The spark coil according to claim 2, wherein a cut portion is formed in at least one of the secondary bobbin and the secondary lead terminal, in a position across which the secondary bobbin and the secondary lead terminal oppose each other.

8. The spark coil according to claim 3, wherein a cut portion is formed in at least one of the secondary bobbin and the secondary lead terminal, in a position across which the secondary bobbin and the secondary lead terminal oppose each other.

9. The spark coil according to claim 4, wherein a cut portion is formed in at least one of the secondary bobbin and the secondary lead terminal, in a position across which the secondary bobbin and the secondary lead terminal oppose each other.

10. The spark coil according to claim 5, wherein a cut portion is formed in at least one of the secondary bobbin and the secondary lead terminal, in a position across which the secondary bobbin and the secondary lead terminal oppose each other.

* * * * *